US009957728B2

(12) United States Patent
Ma

(10) Patent No.: US 9,957,728 B2
(45) Date of Patent: May 1, 2018

(54) ROTATION BASE FOR UMBRELLA

(71) Applicant: Oliver Joen-an Ma, Arcadia, CA (US)

(72) Inventor: Oliver Joen-an Ma, Arcadia, CA (US)

( * ) Notice: Subject to any disclaimer, the term of this patent is extended or adjusted under 35 U.S.C. 154(b) by 0 days. days.

(21) Appl. No.: 14/490,435

(22) Filed: Sep. 18, 2014

(65) Prior Publication Data

US 2015/0076313 A1 Mar. 19, 2015

Related U.S. Application Data

(60) Provisional application No. 61/880,098, filed on Sep. 19, 2013.

(51) Int. Cl.
*A45B 23/00* (2006.01)
*E04H 12/22* (2006.01)

(52) U.S. Cl.
CPC ..... *E04H 12/2238* (2013.01); *A45B 23/00* (2013.01); *E04H 12/2284* (2013.01); *A45B 2023/0031* (2013.01)

(58) Field of Classification Search
CPC ..... A45B 23/00; A45B 2023/0012; E04H 12/2284; Y10T 403/595; Y10T 403/32336; Y10T 403/32361; B60N 2/0843
USPC .... 248/519, 521, 522, 523, 527, 349.1, 429; 135/15.1, 16; 292/194, 213, 217, 218, 292/219, 226, 228, 199, 200, 202–204, 292/210, 180; 70/181–187; 403/92, 93, 403/95, 322.4, 322.1
See application file for complete search history.

(56) References Cited

U.S. PATENT DOCUMENTS 1,261,142 A 4/1918 McNichol
1,711,831 A * 5/1929 Clavin ..... 292/228
1,838,199 A * 12/1931 Thomas ..... B60N 2/0707 248/429
1,940,523 A 12/1933 Barclay
2,036,033 A 3/1936 Fisher
2,146,658 A 2/1939 Leopold
2,652,845 A 9/1953 O'Neill et al.
2,952,471 A 9/1960 Thorpe
(Continued)

FOREIGN PATENT DOCUMENTS

DE 202006002271 U1 6/2006
EP 0 060 957 9/1982
(Continued)

OTHER PUBLICATIONS

Activa Leisure, 2010 Product Catalog.
(Continued)

*Primary Examiner* — Jonathan Liu
*Assistant Examiner* — Guang H Guan
(74) *Attorney, Agent, or Firm* — Knobbe Martens Olson & Bear LLP

(57) ABSTRACT

An umbrella base is provided that includes a first support, a second support and a control device, which can include a foot pedal. The second support is rotatably coupled with the first support. The foot pedal is coupled with the first support, e.g., at a pivot. The foot pedal has at least one lateral member. The lateral member projects downward from an arm. The lateral member is located on the same side of the second support as the foot pedal. Movement of the foot pedal downward causes lateral members to disengage from the second support permitting the second support to rotate.

13 Claims, 7 Drawing Sheets

(56) References Cited

U.S. PATENT DOCUMENTS 3,025,058 A 3/1962 Brumfield
3,119,588 A 1/1964 Keats
3,179,438 A 4/1965 Field
3,259,432 A 7/1966 Jackson
3,353,837 A 11/1967 Marcyan
3,372,855 A 3/1968 Keith
3,606,445 A 9/1971 Wunderlich
3,632,029 A 1/1972 Sonner
3,633,242 A 1/1972 Wasofsky
3,635,491 A 1/1972 Drews et al.
3,841,631 A 10/1974 Dolan
3,949,901 A 4/1976 Tokita
4,000,750 A 1/1977 Becher
4,063,616 A 12/1977 Gutierrez
4,069,559 A * 1/1978 Weman ..... A44B 11/2526 24/650
4,249,282 A 2/1981 Little
4,296,693 A 10/1981 Archer
4,591,126 A 5/1986 Berney
D286,116 S 10/1986 Tegze
4,790,029 A 12/1988 LaFleur et al.
D305,702 S 1/1990 Taliani et al.
4,903,859 A 2/1990 Derby et al.
4,973,327 A 11/1990 Goodrich, Jr. et al.
5,104,236 A 4/1992 LaFleur
5,152,495 A 10/1992 Jacinto et al.
5,158,369 A 10/1992 Derby
5,167,393 A * 12/1992 Hayakawa ..... B60N 2/0705 248/430
5,207,407 A 5/1993 Fitzsimmons et al.
5,209,364 A 5/1993 LaPoint, Jr.
5,220,740 A 6/1993 Brault
5,248,140 A 9/1993 Matherne et al.
5,257,983 A 11/1993 Garyantes et al.
5,259,612 A 11/1993 Matherne et al.
5,283,595 A 2/1994 Krukovsky
5,289,937 A 3/1994 Boots
5,322,023 A 6/1994 Hammond
5,323,922 A 6/1994 Lapoint et al.
5,328,268 A 7/1994 Lafleur
5,330,213 A 7/1994 Peruso
D350,041 S 8/1994 Schwarzli
5,337,989 A 8/1994 Apple
5,354,049 A 10/1994 Matherne et al.
5,375,835 A 12/1994 Van Nimwegen et al.
5,423,611 A 6/1995 Sherrard
5,452,877 A 9/1995 Riffle et al.
5,480,191 A 1/1996 Litin et al.
5,481,822 A 1/1996 Engels
5,492,429 A 2/1996 Hodges
5,520,982 A 5/1996 Grigsby et al.
5,538,155 A 7/1996 Hoekstra
5,599,037 A 2/1997 Spickler
5,615,451 A 4/1997 Peterson et al.
5,628,522 A 5/1997 Hall
5,628,523 A 5/1997 Smith
5,636,649 A 6/1997 Horvath
5,730,668 A 3/1998 Hege et al.
5,743,283 A 4/1998 Horvath
5,823,213 A 10/1998 Patarra
5,826,850 A * 10/1998 Goldsmith ..... 248/415
5,839,714 A 11/1998 Fitzsimmons et al.
5,843,556 A 12/1998 Levas
5,865,541 A 2/1999 Lafleur
5,871,148 A 2/1999 Hafer
5,940,932 A 8/1999 LaHay
5,957,145 A 9/1999 Plumer
5,964,533 A 10/1999 Ziglar
5,968,204 A 10/1999 Wise
5,979,793 A 11/1999 Louis
6,000,549 A 12/1999 Perkins
6,015,057 A 1/2000 Stone et al.
6,089,394 A 7/2000 Ziglar
6,102,569 A 8/2000 Wang
6,105,305 A 8/2000 Edens
6,109,786 A 8/2000 Hafer et al.
6,113,054 A 9/2000 Ma
6,113,270 A 9/2000 Hafer
6,149,025 A 11/2000 Wang
6,196,719 B1 3/2001 Brown
6,203,198 B1 3/2001 Stone
6,220,755 B1 4/2001 Brown et al.
6,305,659 B1 10/2001 Metelski
6,328,470 B2 12/2001 Brown et al.
6,336,450 B1 1/2002 Collet
6,367,494 B1 4/2002 Tung
6,374,839 B2 4/2002 Patarra
6,405,990 B2 6/2002 Davis et al.
6,412,746 B2 7/2002 Davis et al.
6,412,747 B2 7/2002 Davis et al.
6,415,927 B1 7/2002 Stone et al.
6,446,408 B1 9/2002 Gordin et al.
6,446,930 B1 9/2002 Li
D464,190 S 10/2002 Salahub
6,481,591 B2 11/2002 Mendoza et al.
6,488,254 B2 * 12/2002 Li ..... 248/521
6,511,033 B2 1/2003 Li
D470,305 S 2/2003 Clarke
6,523,640 B1 2/2003 Young et al.
6,554,012 B2 4/2003 Patarra
6,554,243 B2 4/2003 Davis et al.
6,565,060 B2 * 5/2003 Li ..... A45B 23/00 248/292.12
6,594,951 B1 7/2003 Reynolds
6,637,717 B2 10/2003 Li
D484,303 S 12/2003 Taylor
6,658,760 B2 12/2003 Kohlman et al.
6,669,045 B2 12/2003 Wang
D485,055 S 1/2004 Taylor
6,682,055 B1 1/2004 Tomlinson et al.
6,732,752 B2 5/2004 Cohen et al.
6,796,319 B1 9/2004 Patarra et al.
6,869,058 B2 3/2005 Tung
6,877,708 B1 * 4/2005 Thurner ..... A47G 33/1213 248/519
6,889,953 B2 5/2005 Harbaugh
D516,297 S 3/2006 Smith et al.
7,090,399 B2 8/2006 Godshaw et al.
7,140,581 B1 11/2006 White
7,143,061 B2 12/2006 Jimenez
7,163,212 B1 1/2007 Rupp
7,195,397 B2 3/2007 Williamson et al.
7,285,111 B2 10/2007 Gaster
7,331,684 B2 2/2008 Tung
7,347,428 B2 3/2008 Edenso
D568,603 S 5/2008 Smith et al.
D573,786 S 7/2008 Smith et al.
D574,143 S 8/2008 Smith et al.
D578,749 S 10/2008 Ng
7,431,259 B2 * 10/2008 Tung ..... 248/521
7,484,704 B2 * 2/2009 Schommertz ..... 248/525
7,503,541 B2 3/2009 Harold et al.
7,513,479 B2 4/2009 Li
7,520,485 B1 4/2009 Giannetto
7,537,015 B1 5/2009 Molnar, IV et al.
7,575,117 B2 8/2009 Redzisz et al.
7,584,563 B2 9/2009 Hillstrom et al.
7,600,917 B2 10/2009 Richardson, Jr.
7,614,600 B1 11/2009 Smith et al.
7,641,165 B2 1/2010 Li
7,644,903 B2 * 1/2010 Amato ..... F16M 11/08 108/94
D617,041 S 6/2010 Shi
7,753,546 B2 7/2010 Kuelbs
D621,148 S 8/2010 Brady
D621,149 S 8/2010 Brady
7,784,761 B2 8/2010 Ma
7,836,902 B2 * 11/2010 Tung ..... 135/20.3
7,891,633 B2 2/2011 Li
7,958,901 B2 6/2011 Lai
8,070,006 B2 12/2011 Austin et al.
8,104,492 B2 1/2012 Dan
D655,531 S 3/2012 Gharst
8,485,757 B2 7/2013 Nomoto

(56) References Cited

U.S. PATENT DOCUMENTS

| | | | | |
|---|---|---|---|---|
| 8,556,100 | B2 | 10/2013 | Austin et al. | |
| 8,567,729 | B2 * | 10/2013 | Nemish | 248/125.8 |
| D697,705 | S | 1/2014 | Ma | |
| 8,632,045 | B2 | 1/2014 | Ma | |
| 8,657,246 | B2 | 2/2014 | Ma | |
| 8,714,511 | B2 | 5/2014 | Zoeteman | |
| 8,807,513 | B2 * | 8/2014 | Volin | 248/521 |
| 8,894,281 | B2 | 11/2014 | Town et al. | |
| 8,919,361 | B2 * | 12/2014 | Ma | E04H 12/2238 135/16 |
| D724,309 | S | 3/2015 | Ma | |
| D732,817 | S | 6/2015 | Elstow | |
| D740,546 | S | 10/2015 | DeVaney | |
| 2001/0013358 | A1 | 8/2001 | Patarra | |
| 2001/0040208 | A1 | 11/2001 | Li | |
| 2001/0045498 | A1 | 11/2001 | Davis et al. | |
| 2002/0185582 | A1 | 12/2002 | Li | |
| 2003/0145498 | A1 | 8/2003 | Venegas, Jr. | |
| 2003/0230692 | A1 | 12/2003 | Davis et al. | |
| 2004/0056169 | A1 | 3/2004 | Harbaugh | |
| 2004/0069922 | A1 | 4/2004 | Wu | |
| 2004/0108439 | A1 | 6/2004 | Ma | |
| 2004/0163336 | A1 | 8/2004 | Hsu | |
| 2004/0177871 | A1 | 9/2004 | Harbough | |
| 2004/0195487 | A1 | 10/2004 | Harbaugh | |
| 2005/0023428 | A1 | 2/2005 | Woude et al. | |
| 2005/0161067 | A1 | 7/2005 | Hollins | |
| 2005/0189005 | A1 | 9/2005 | Smith et al. | |
| 2006/0054206 | A1 | 3/2006 | Bilotti | |
| 2007/0080277 | A1 | 4/2007 | Chen | |
| 2008/0111046 | A1 | 5/2008 | Tung | |
| 2009/0174162 | A1 | 7/2009 | Gass et al. | |
| 2009/0320341 | A1 | 12/2009 | Hillstrom et al. | |
| 2010/0065709 | A1 | 3/2010 | Ying | |
| 2010/0147341 | A1 | 6/2010 | Li | |
| 2010/0206346 | A1 | 8/2010 | Tung | |
| 2011/0232704 | A1 | 9/2011 | Li | |
| 2012/0024329 | A1 | 2/2012 | Ma | |
| 2012/0125388 | A1 * | 5/2012 | Kuo | 135/23 |
| 2013/0146739 | A1 | 6/2013 | Zhao | |
| 2013/0146740 | A1 * | 6/2013 | Ma | F16M 13/00 248/519 |
| 2014/0230866 | A1 | 8/2014 | Paolucci | |
| 2014/0263926 | A1 | 9/2014 | LeAnna | |
| 2015/0076313 | A1 * | 3/2015 | Ma | A45B 23/00 248/514 |

FOREIGN PATENT DOCUMENTS

| | | |
|---|---|---|
| EP | 0 818 594 | 1/1998 |
| EP | 0 822 305 | 2/1998 |
| FR | 2 576 048 | 7/1986 |

OTHER PUBLICATIONS

Treasure Garden, 2010 Product Catalog.

Extended European Search Report issued in European Patent Application No. 14185666.6, dated Jun. 24, 2015.

* cited by examiner

ROTATION BASE FOR UMBRELLA

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57.

BACKGROUND OF THE INVENTION

Field of the Invention

The invention relates to the field of shade structures, particularly umbrella and parasol devices and more particularly to an umbrella and a rotation base therefor.

Description of the Related Art

Umbrellas or parasols are devices which are typically utilized in an outdoor setting, such as in an outdoor patio, balcony, garden, cafe, and the like to provide shade and protection against the elements. Umbrellas or parasols generally include a canopy assembly that comprises a fabric-like material mounted over a plurality of support ribs. The support ribs can be collapsed into a storage position for the canopy assembly and can be deployed and supported in position to hold up and extend the fabric and thereby provides protection from the elements. The canopy assembly is generally supported from beneath or from above.

Umbrellas supported from above have the advantage of providing space below the canopy where people can sit without the obstruction of a pole extending from below the canopy to the ground. Such umbrellas are sometimes called cantilever or side support umbrellas, and generally are of greater weight than other types of (generally smaller) umbrellas.

In order to make the positioning of cantilever and other types of larger umbrellas more flexible rotation base designs are used. These bases permit the upright pole to rotate about its axis so that the canopy can swing about a range of positions.

SUMMARY OF THE INVENTION

There is a need for new cantilever umbrellas that includes rotation bases that are more compact and simpler to construct.

In one embodiment, an umbrella rotation base is provided that includes a first support and a second support. The second support is rotatably coupled with the first support. The second support has a sprocket mounted thereto. The sprocket includes a plurality of radial projections. A control device coupled with the first support at a pivot. The control device has a first end disposed away from the first support and a second end disposed adjacent to the sprocket. The sprocket has a U-shaped member disposed at the second end of the control device. In a first position of the control device, three sides of the U-shaped member surround one of the radial projections, which prevent rotation of the second portion of the base relative to the first portion of the base. In a second position of the control device, three sides of the U-shaped member are spaced above the radial projection of the sprocket. The second position of the control device permits rotation of the second portion of the base relative to the first portion of the base.

In another embodiment, an umbrella base is provided. The base includes a first support and a second support. The first support comprises a planar portion and a concave portion extending above the planar portion. The second support has a first portion disposed within the concave portion and a second portion disposed above the first portion. The second portion has a plurality of radial projections. A control device coupled with the planar portion of the first support. For example, the control device can include a lever pivotably coupled with the planer portion. One or more, e.g., two, upright projections are coupled with the lever. The base is configured such that upon a first end of the lever being moved, the upright projections are moved away from the radial projections of the second support, which allows the second support to rotate relative to the first support.

In another embodiment, an umbrella base is provided. The base includes a first support, a second support and a foot pedal. The second support is rotatably coupled with the first support. The foot pedal is coupled with the first support at a pivot. The foot pedal has a first engagement member and a second engagement member. The engagement members project downward from an arm. The engagement members are located on the same side of the second support as the foot pedal. Movement of the foot pedal downward causes engagement members to disengage from the second support permitting the second support to rotate.

An umbrella base is provided that includes a first support, a second support and a control device, which can include a foot pedal. The second support is rotatably coupled with the first support. The foot pedal is coupled with the first support, e.g., at a pivot. The foot pedal has at least one engagement member. The engagement member projects downward from an arm. The engagement member is located on the same side of the second support as the foot pedal. Movement of the foot pedal downward causes the engagement member to disengage from the second support permitting the second support to rotate.

The engagement between the control device and the second support can be by any suitable device. For example, a gear, sprocket or plate can be disposed on the second support at the same elevation as a portion of the lateral members. The plate need not have teeth, but rather any sort of projections can be provided to be engaged by the lateral members. While a plurality of lateral member is preferred in some cases, there can be a single lateral member.

In various embodiments, the level of the actuator (e.g., foot pedal) is above the level of engagement features that permit and prevent rotation of the second support. This advantageously increases ground clearance at the actuator, at least by the vertical distance of the foot pedal over the elevation of a horizontal plane intersecting a pivot about which the control device operates, if the control device is pivoted on the rotation base.

In various embodiments, the control device is entirely located on one side of the rotation base. In other words, the control device has an inner portion that is at or outward of the outer periphery of the rotatable support. This keeps the control device more compact and also allows the structures of the control device to be kept away from the central region where the umbrella pole mounting and other mounting features are disposed and accessed.

Another advantageous embodiment provides that a portion of a control device that engages both fixed and rotatable base portions is configured as a monolithic structure. These portions can be formed in a single piece of material and bent or molded into a shape providing any one or all of engagement surfaces, pivot locations and elevation raising expanses.

BRIEF DESCRIPTION OF THE DRAWINGS

These and other features, aspects and advantages are described below with reference to the drawings, which are intended to illustrate but not to limit the inventions. In the drawings, like reference characters denote corresponding features consistently throughout similar embodiments.

DETAILED DESCRIPTION OF THE PREFERRED EMBODIMENT

While the present description sets forth specific details of various embodiments, it will be appreciated that the description is illustrative only and should not be construed in any way as limiting. Furthermore, various applications of such embodiments and modifications thereto, which may occur to those who are skilled in the art, are also encompassed by the general concepts described herein. Each and every feature described herein, and each and every combination of two or more of such features, is included within the scope of the present invention provided that the features included in such a combination are not mutually inconsistent.

Figure 1:
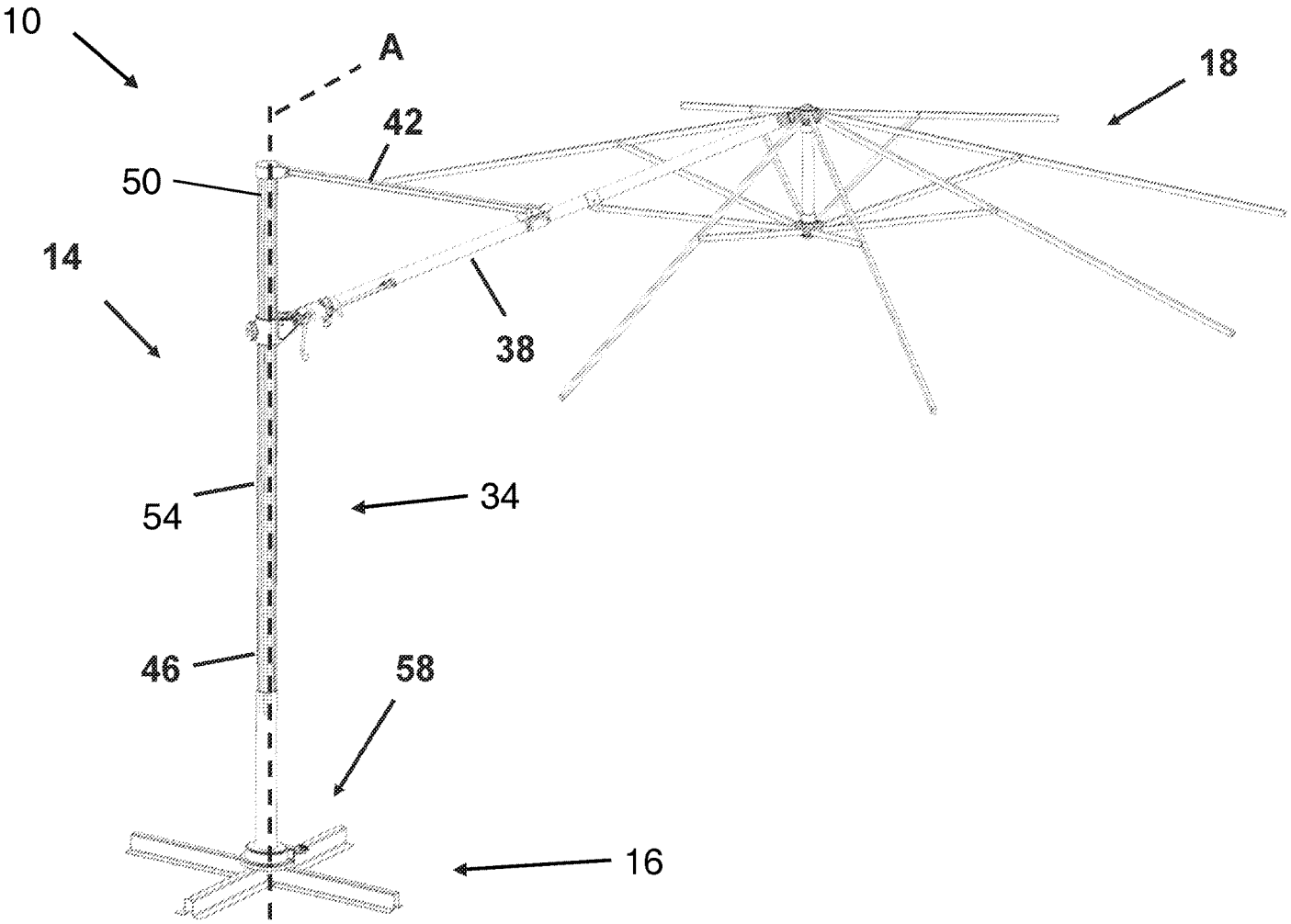
FIG. 1 is a side perspective view of an umbrella frame and pole assembly for an umbrella.
Figure 2:
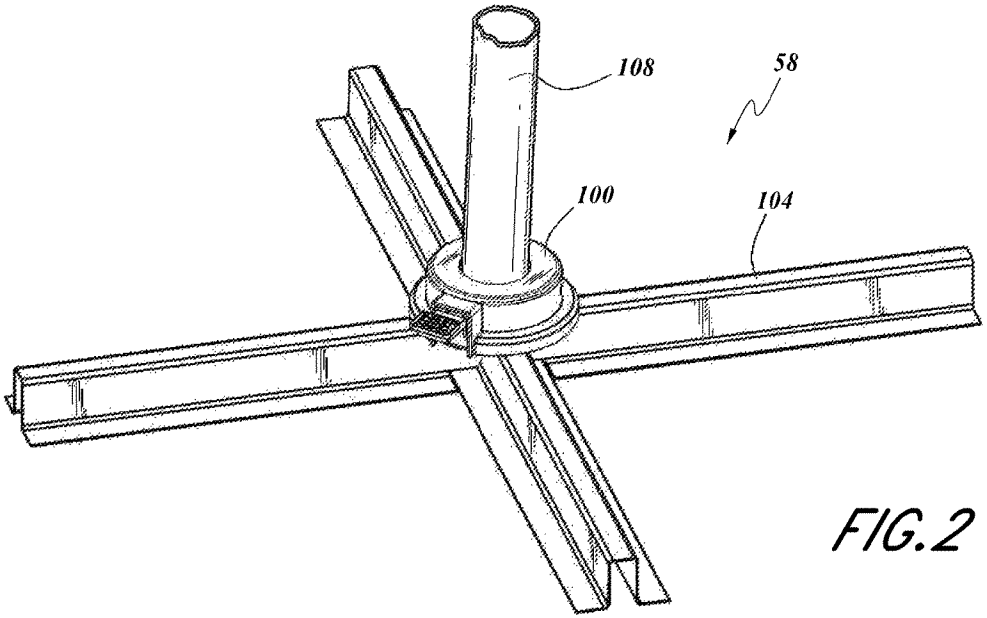
FIG. 2 is a perspective view of an umbrella assembly including an upright pole and an umbrella rotation base.
Figure 3:
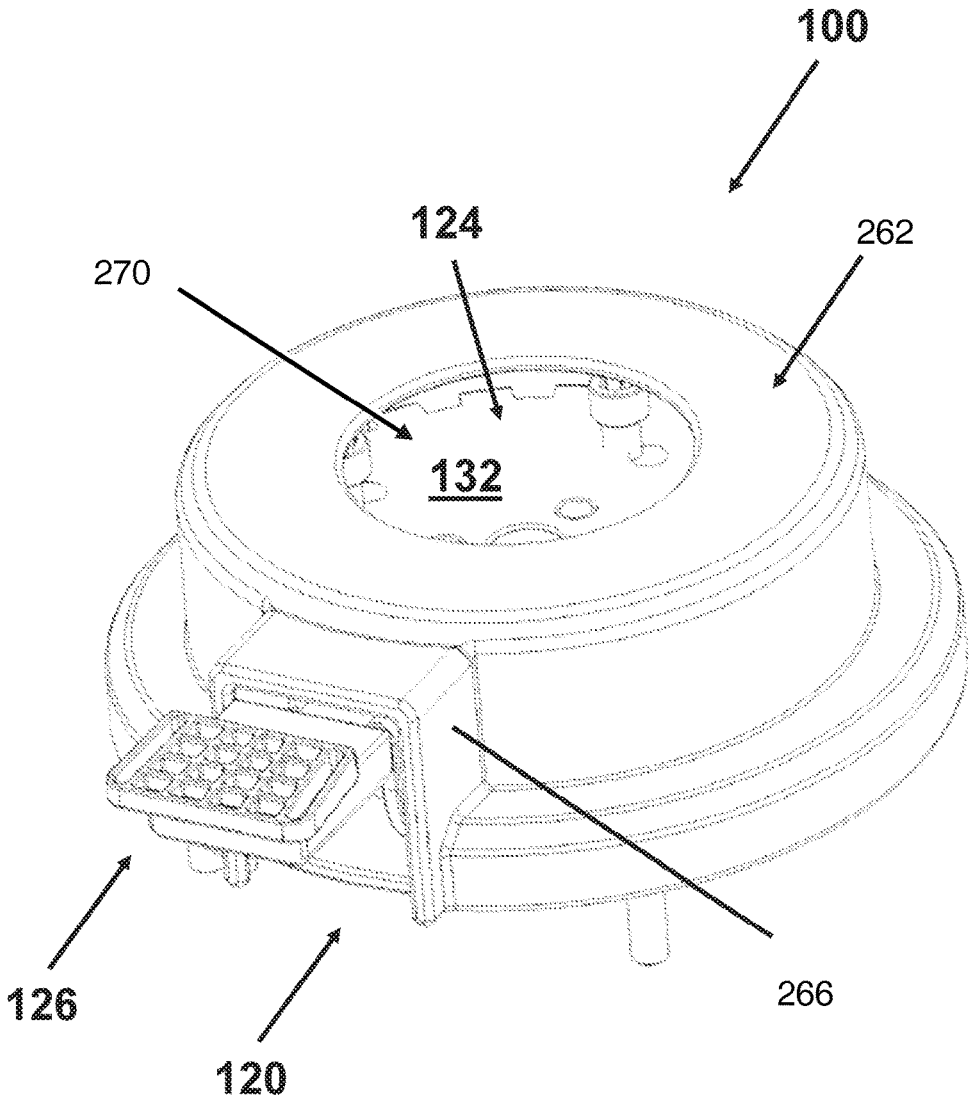
FIG. 3 is a perspective view of the umbrella rotation base shown in FIGS. 1-2.

FIG. 1 illustrates one embodiment of an umbrella 10 that can be positioned in a variety of useful positions to provide shelter. One mode of positioning the umbrella 10 is to move it about an axis A extending upright along a support structure 14 of the umbrella. In this way the location of a sheltering member, e.g., a canopy assembly 18 or a canopy fabric, can be moved about a base 16 of the umbrella 10. Additional details of the umbrella 10 are discussed in U.S. 61/880,059, filed Sep. 19, 2013 a copy of which is included in an Appendix. The details of the 61/880,059 application are incorporated by reference into the body of this specification.

The support structure 14 can take a variety of forms. In one embodiment, the support structure 14 includes a support pole 34 and a strut 42 coupled with the support pole. The strut 42 and the support pole 34 also are coupled with a boom 38. In the illustrated embodiment, the axis A is disposed along the longitudinal axis of the support pole 34.

The support pole 34 has a lower end 46, an upper end 50 and an elongate body 54 extending therebetween. The pole can be configured to be mounted in a fixed position to the ground at or adjacent to the lower end 46.

A pivot device 58 coupled with the lower end 46 enables the pole 34 and the boom 38 to rotate about the axis A and integration into a decorative umbrella base. The pivot device 58 includes a rotation base 100 and a cross-brace 104. The cross-brace 104 advantageously create a fairly wide profile to make the umbrella 10 more stable. Generally, a decorative base cowling (not shown) is provided to conceal the cross-brace 104. The cowling will have an opening through which an umbrella pole 108 can extend. The pole 108 can comprise the support 34 or can be a sleeve into which the support 34 is inserted.

FIGS. 3-6 show that the rotation base 100 can include a first support 120, a second support 124, and a control device 126 for engaging and disengaging the first and second supports 120, 124 to each other. The second support 124 is rotatably coupled with the first support 120. The second support 124 has a sprocket 132 rotatably mounted thereto. The second support 124 also has one or a plurality of mounts 136 for connecting the umbrella pole 108 and a plurality of mounts 140 for mounting the second support to the cross-brace 104. The mounts 136 can be disposed on the sprocket 132 such that rotation of the sprocket and the umbrella pole 108 is one-to-one. The mounts 140 can be disposed on a flange 144 of the first support 120. The flange 144 provides a rigid connection such that the first support 120 is not moveable relative to the cross-brace 104 or other lower ground connection.

The flange 144 includes a planar portion 150 and an arcuate portion 154 that extends away from the planar portion 150. The arcuate portion 154 can include a concave portion disposed away from the planar portion 150. The concave portion is disposed around a space in which part of the second support 124 can be mounted. The second support 124 can include a rotation device such as a rotation bearing that permits a portion of the second support to be rotated within the arcuate portion 154 as indicated by the arrow A.

The flange 144 also includes a portion of a pivot 162. In one embodiment, the flange 144 includes at least one, e.g., two mounting elements 166 for disposing an axle or other pivot device on the first support 120. The mounting element 166 can be disposed on, e.g., vertically mounted to, the planar portion 150 of the flange 144. The mounting element 166 can include an aperture 170 through which an axle (not shown) can be disposed. In one embodiment, there are two mounting elements 166, each having an aperture 170. Where multiple mounting elements and apertures 166, 170 are provided multiple axles may be used. The connection of the mounting element(s) 166 to the control device 126 is discussed in greater detail below.

Figure 4:
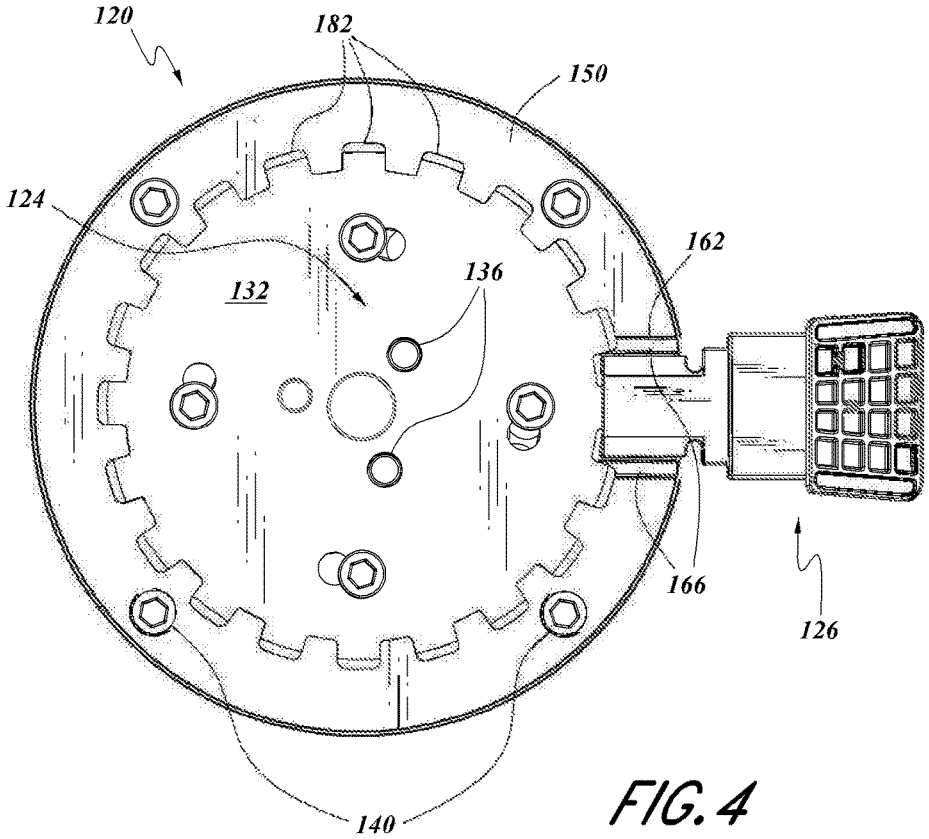
FIG. 4 is a top view of the umbrella rotation base of FIG. 3 with a housing removed, the view showing a first position of a control device relative to radial projections of a rotatable member.

FIG. 4 shows that the sprocket 132 includes a plurality of radial projections 182. The projections 182 can be disposed about the outer circumference of the sprocket 132 at intervals, e.g., at regular intervals. Each of the radial projections 182 can define a discrete spaced apart radial position of the sprocket relative to the first portion 120 (and the ground to which it is coupled). The radial projections 182 can be positioned at any interval. In one embodiment, radial projections 182 are positioned at about 20 degree intervals from each other to allow for fine adjustment of the location of the shade provided by the canopy assembly 18.

Figure 7:
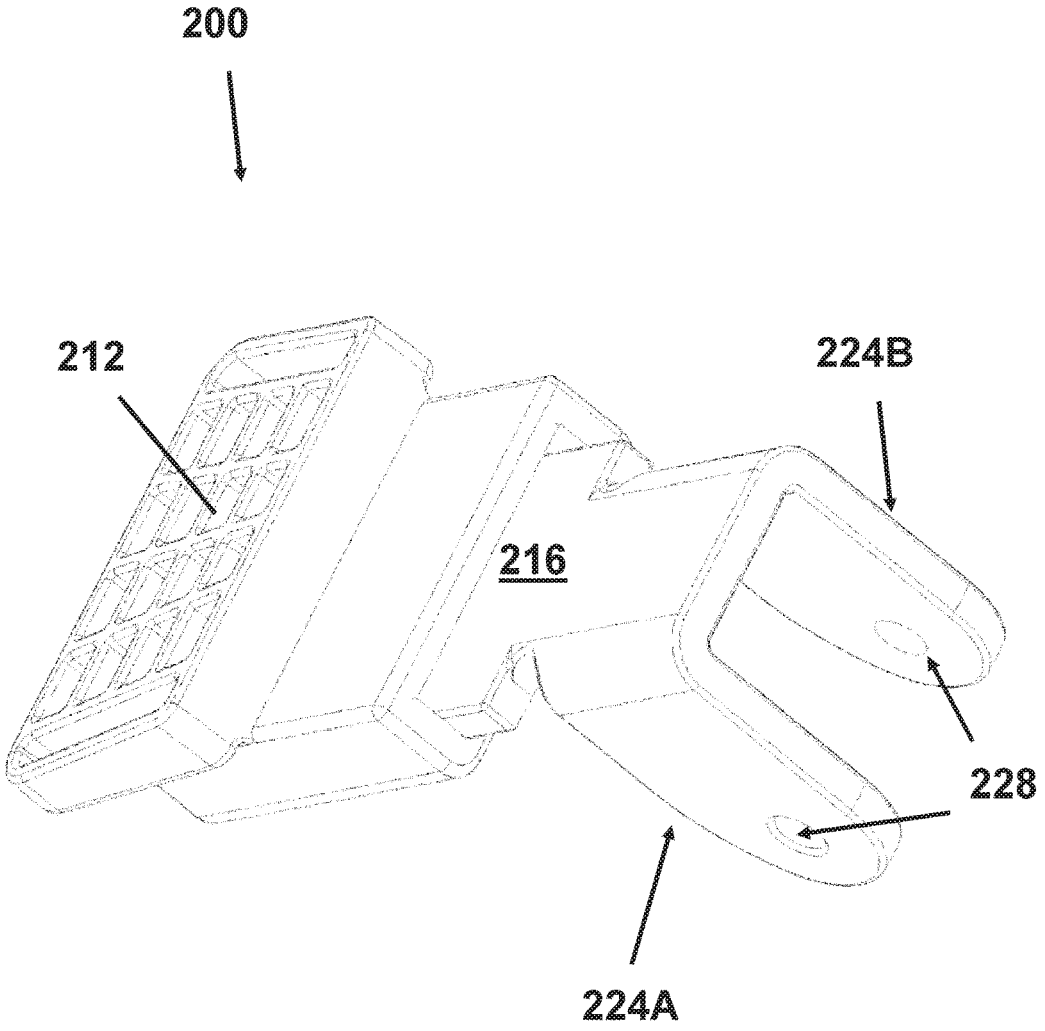
FIG. 7 is a perspective view of one embodiment of a control device having a foot pedal.
Figure 8:
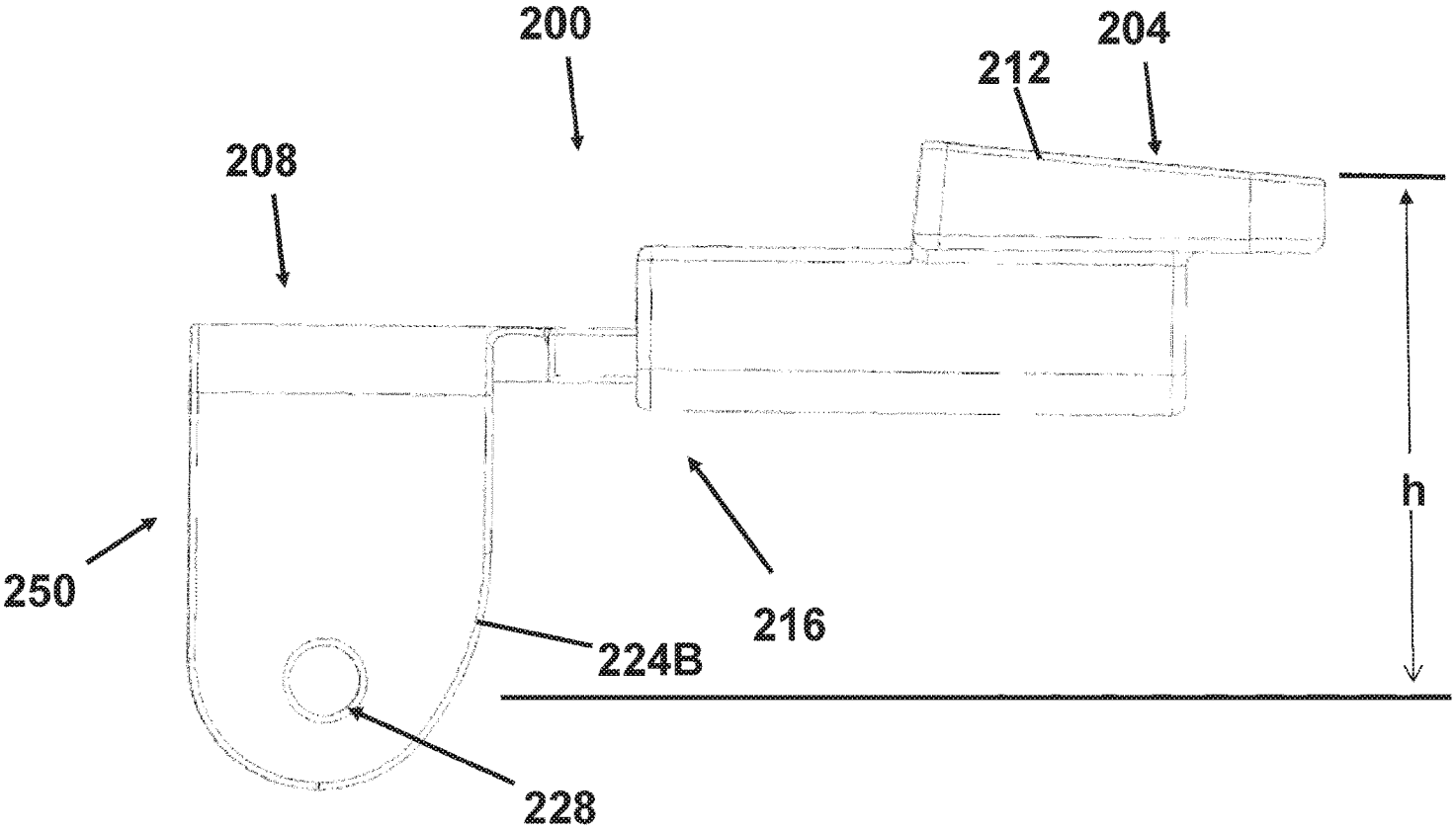
FIG. 8 is a side view of the control device of FIG. 7 illustrating the relative positions of the foot pedal, radial projection engagement feature and pivot portion thereof.

FIG. 8 shows that the control device 126 can have an actuator 200 that has a first end 204 disposed away from the first support 120 and a second end 208 disposed adjacent to the sprocket 132. The actuator 200 can be a lever with a special configuration to optimize engagement with and disengagement from the radial projections 182 of the sprocket 132. In one form, the actuator 200 includes a foot pedal 212 coupled with the pivot 162. FIGS. 7 and 8 show that the actuator 200 has an elongate configuration in which an arm 216 extends between the first and second ends 204, 208. The length of the arm 216 allows the foot pedal 212 to be disposed away from the pivot 162 so that the actuator 200 can be pivoted a sufficient amount to engage and disengage the control device 126 as discussed further below.

Figure 6:
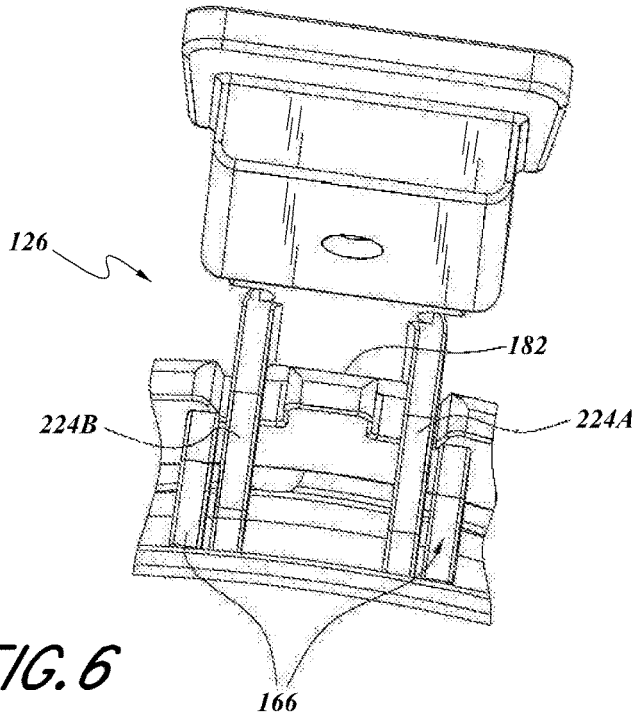
FIG. 6 is another detail perspective view of the control device illustrating how a portion thereof adjacent to the rotatable portion of the base engaged radial projections thereof.

The actuator 200 can include first and second lateral members 224A, 224B. The lateral members 224A, 224B can perform multiple functions. The lateral members 224A, 224B are sometimes referred to as upright members in that when the lateral members 224A, 224B are assembled on the base 10 the generally extend upwardly from a pivot to an arm and/or foot pedal elevation. In some embodiments, the lateral members 224A, 224B include apertures 228 for mounting the actuator 160 to the pivot 162. The apertures 228 can be configured to receive an axle and in some embodiments, each aperture 228 receives separate short axle that also extends through the aperture 170 of the mounting elements 166. FIG. 6 shows that the lateral member 224A is mounted between the lateral member 224B and one of the mounting elements 166 and the lateral member 224B is mounted between the lateral member 224A and one of the mounting elements 166. FIG. 8 shows that in some embodiments a function of the lateral members 224A, 22B is to elevate an upper portion of the actuator, e.g., the foot pedal 212, above the axis of the pivot 162 by an amount h. The axis of the pivot 162 is generally centered on the apertures 228. If the foot pedal 212 is slanted as shown in FIG. 8, the minimum value of h is at the outermost portion of the pedal 212. By the position of the outer portion of the actuator 20 (e.g., the foot pedal 212) at an elevation above the pivot 162 by the dimension h, the range of motion allows the lateral members 224A, 224B to be disposed between adjacent projections 182.

The arrangement also enables one of the projections 182 to be received between the lateral members 224A, 224B, e.g., at a third elevation between the elevation of the pedal 212 and the elevation of the pivot 162. FIG. 6 shows that when so received a small amount of play is provided between the lateral members 224A, 224B and the projections 182. This allows minor rotations of the second support 124 relative to the first support 120. This small amount of play allows the umbrella to move a little bit under loads such as wind, which can be important for large umbrellas. This movement allows some of the load to be dissipated rather than being immediately applied to the actuator 200.

Providing for engagement between the two members 224A, 224B and two faces of the sprocket 132 also allows such loads to be divided among the two members. Referring to FIG. 6, a portion of a clockwise load is applied by the projection 182 to the right of the lateral member 224A and a portion of the load to be applied to the lateral member 224B by the projection 182 disposed between the lateral members 224A, 224B. A portion of a counter-clockwise load is applied by the projection 182 to the left of the lateral member 224B and a portion of the load to be applied to the lateral member 224A by the projection 182 disposed between the lateral members 224A, 224B.

Figure 5:
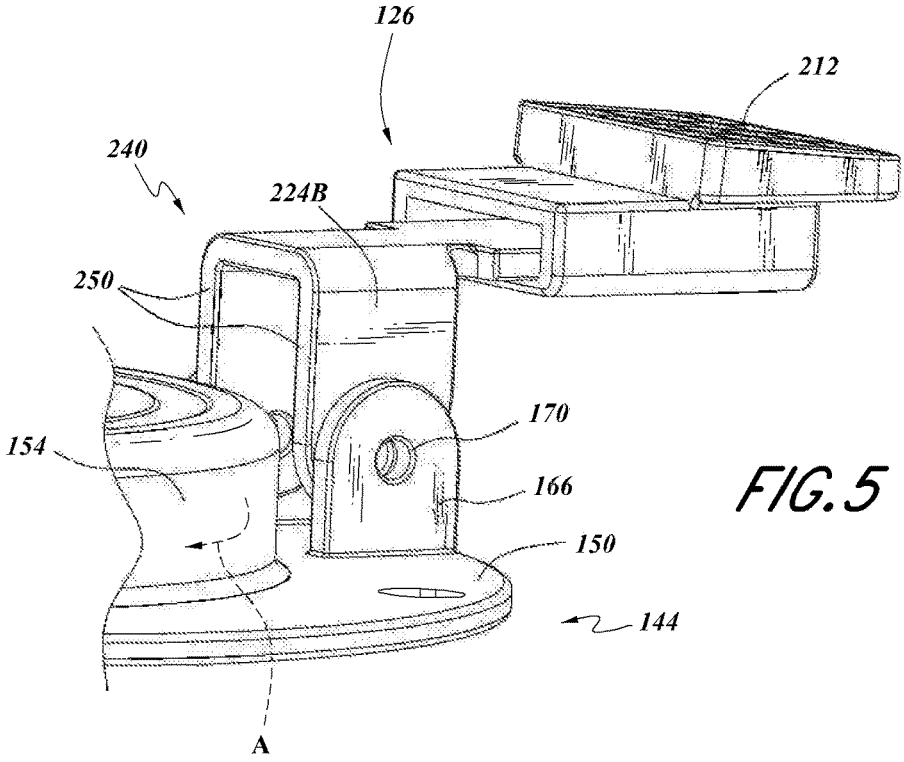
FIG. 5 is a detail perspective view of the control device illustrating a pivot engagement thereof with a non-rotatable portion of the umbrella rotation base of FIG. 3.

FIGS. 5 and 7 show that the control device 126 can have a U-shaped member 240 disposed at the second end 208 of the control device. The U-shaped member 240 can include the lateral members 224A, 22B and part of the arm 216 disposed at the second end 208 of the actuator 200. In one embodiment, the U-shaped member 240 and the arm 216 from which it extends are of a monolithic construction. For example, these structures can be formed from a single piece of sheet metal. Cuts can be made to define the outlines of the lateral members 224A, 224B, and the lateral members can be bent to the orientation shown in FIG. 7.

One advantage of the U-shaped member 240 involves the position of the engagement features 250 for coupling the control device 126 to the second support 124 to prevent rotational movement between the first and second supports 120, 124. The engagement features 250 are disposed on the same side of the umbrella pole 108 as is the actuator 200. This makes the control device 126 more compact and less obtrusive to the user.

In some embodiments the rotation base 100 includes a cover 262 that is provided the second support 124 such that the working components are shielded from view and also from the user. The cover 262 can have a generally convex shape such that the height of the first and/or second supports 120, 124 can be accommodated within the cover. In one embodiment, the cover 262 includes an actuator recess 266 for accommodating the lateral portions 224A, 224B such that the engagement features 250 and the edges of the radial projections 182 of the sprocket 132 are enclosed. The cover also includes an opening 270 through which the umbrella pole 108 extends.

Operation of the rotation base 100 and the control device 126 is simple and straight forward. The control device 126 is placed in a first position illustrated in FIGS. 4 and 6 in which sides of the U-shaped member 240, e.g., the lateral portions 224A, 224B, and the portion extending from the arm 216, surround one of the radial projections 182. The first position is one in which prevents rotation of the second portion 124 of the base 100 relative to the first portion 120. In a second position of the control device 126, the U-shaped member 240 does not surround the projection 182 so the sprocket 132 is able to rotate. This allows the second portion 124 of the base 100 to rotate relative to the first portion 120 of the base.

The base 100 is well suited to support the umbrella 10 but could be used for rotational positioning of other structures or device.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. In addition, while several variations of the inventions have been shown and described in detail, other modifications, which are within the scope of these inventions, will be readily apparent to those of skill in the art based upon this disclosure. It is also contemplated that various combination or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

What is claimed is:

1. An umbrella base comprising:

a first support comprising a planar portion with an upper surface, a mounting element extending upward from the upper surface, and an arcuate portion extending above the planar portion, the mounting element spaced apart from the arcuate portion;

a cover extending over the arcuate portion, the cover comprising an actuator recess, the actuator recess extending over the mounting element;

a second support at least partially disposed within the cover and at least partially disposed above the planar portion of the first support, the second support comprising a plurality of radial projections; and a control device pivotably coupled with the mounting element about a pivot axis, the control device comprising a first end having a foot pedal, a second end, and an upright projection at the second end of the control device, the upright projection extending upward from adjacent to the pivot axis of the control device to a location below a top surface of the control device, the second end of the control device disposed within the actuator recess, the pivot axis extending through the actuator recess, and the first end of the control device disposed outside the actuator recess;

wherein the control device has a first position in which the first end of the control device is in an elevated position and the upright projection is placed between two adjacent projections of the plurality of radial projections, at least one of the radial projections overlapping an overlap portion of the upright projection in a circumferential direction, whereby the second support cannot rotate freely relative to the first support; and wherein the control device has a second position in which the first end of the control device is in a lowered position and the upright projection is disengaged from between the two adjacent projections, a radially innermost end of the overlap portion of the upright projection being spaced radially outward of a radially outermost end of each of the two adjacent projections in the second position, whereby the second support can rotate relative to the first support;

wherein the second end of the control device remains within the actuator recess when in the first position and the second position, and the first end of the control device is disposed outside the actuator recess when in the first position and the second position.

2. The umbrella base of claim 1, wherein the upright projection comprises an aperture at the pivot axis for pivotably mounting the upright projection relative to the mounting element of the first support.

3. The umbrella base of claim 2, wherein the upright projection comprises a lower portion and an upper portion, the lower portion comprising the aperture and the upper portion comprising an engagement feature for engaging the plurality of radial projections of the second support.

4. The umbrella base of claim 1 wherein the second support comprises a sprocket.

5. The umbrella base of claim 1, wherein the top surface of the control device does not extend towards the second support beyond the radially outermost end of each of the two adjacent projections when the control device is in the second position.

6. An umbrella rotation base comprising:

a first support;

a second support rotatably coupled with the first support, the second support including a sprocket, the sprocket including a plurality of radial projections;

a control device coupled with the first support at a pivot, the control device comprising:

a first end disposed away from the first support;

a second end disposed adjacent to the sprocket; and a U-shaped member disposed at the second end of the control device, the U-shaped member comprising two sides, a transverse side connecting the two sides, and an open end, the two sides each comprising an upper portion and a lower portion, the pivot being located on the lower portion of at least one of the two sides and adjacent to the open end;

the U-shaped member having an edge disposed along the two sides and the transverse side the edge having upper segments and lower arcuate segments, the lower arcuate segments coupled with the upper segments and curving radially away from the second support, each of the two sides extending radially inward towards the second support from the pivot to the edge to define a lateral portion, wherein each of the lateral portions extends down from the transverse side to below the pivot throughout the respective lateral portion and extends between the pivot and the edge;

wherein the lateral portions of the two sides and the transverse side of the U-shaped member surround one of the plurality of radial projections of the sprocket in a first position of the control device, thereby preventing a rotation of the second support of the umbrella rotation base relative to the first support of the umbrella rotation base, and the two sides and the transverse side of the U-shaped member are spaced away from and positioned radially outward of the one of the plurality of radial projections in a second position of the control device, thereby permitting a rotation of the second support relative to the first support.

7. The umbrella rotation base of claim 6, wherein the control device further comprises a foot pedal disposed at the first end thereof.

8. The umbrella rotation base of claim 6, wherein the U-shaped member comprises a monolithic construction.

9. The umbrella rotation base of claim 6, wherein the control device is located only on one side of the umbrella rotation base.

10. The umbrella rotation base of claim 6, wherein the pivot is disposed at an elevation below a lowermost surface of the first end of the control device.

11. The umbrella rotation base of claim 6, wherein the pivot is located at a first elevation, the first end of the control device is located at a second elevation above the first elevation and an engagement feature of the control device is located at a third elevation between the first and second elevations.

12. An umbrella base comprising:

a first support;

a second support rotatably coupled with the first support;

a cover extending over the first support and the second support such that a radially outermost edge of the second support is enclosed by the cover;

a control device comprising an arm, a foot pedal, a first engagement member projecting downward from the arm, and a second engagement member projecting downward from the arm, the control device coupled with a mounting bracket on the first support, the mounting bracket disposed underneath the cover;

wherein the first engagement member, the second engagement member and the foot pedal are together located on a peripheral side of the second support, the first and second engagement members are disposed within the cover with the foot pedal disposed outside the cover, a pivot is located on a lower portion of at least one of the first and second engagement members for coupling the control device with the mounting bracket, and the pivot is disposed underneath the cover;

wherein the control device is configured such that when the first and second engagement members are engaged with the second support, a movement of the foot pedal downward causes the first and second engagement members to be disengaged from the second support, thereby permitting the second support to rotate relative to the first support;

wherein the control device is configured such that when the first and second engagement members are disengaged from the second support, a movement of the foot pedal upward causes the first and second engagement members to engage the second support to prevent the second support from rotating relative to the first support; and wherein the first and second engagement members of the control device remain underneath the cover both when engaged with and disengaged from the second support.

13. The umbrella base of claim 12, wherein a radially innermost end of the control device is configured to be disengaged from the second support by moving radially outward from the second support to a first location radially outward of a radially outermost edge of the second support; and the radially innermost end of the control device is configured to be engaged with the second support by moving radially inward toward the second support from the first location to a second location radially inward of the radially outermost edge of the second support.

* * * * *